US006000073A

United States Patent [19]

Eddington

[11] Patent Number: 6,000,073

[45] Date of Patent: Dec. 14, 1999

[54] JET ZONE DISTRIBUTION SYSTEM FOR SPAS

[76] Inventor: Richard Alex Eddington, 3550 S. 2000 East, Salt Lake City, Utah 84109

[21] Appl. No.: 09/165,529

[22] Filed: Oct. 2, 1998

Related U.S. Application Data

[63] Continuation-in-part of application No. 09/037,787, Mar. 10, 1998, which is a continuation of application No. 08/677,840, Jul. 10, 1996, Pat. No. 5,754,989.

[51] Int. Cl.[6] ..... A47K 3/00

[52] U.S. Cl. ..... 4/541.1

[58] Field of Search ..... 4/541.1–541.5

[56] References Cited

U.S. PATENT DOCUMENTS 4,857,112 8/1989 Franninge ..... 4/541.1 X 4,907,305 3/1990 Teramachi et al. ..... 4/541.5 X 5,526,538 6/1996 Rainwater ..... 4/541.1

FOREIGN PATENT DOCUMENTS 135058 3/1984 Japan ..... 4/541.1

*Primary Examiner*—Charles E. Phillips

*Attorney, Agent, or Firm*—James Sonntag

[57] ABSTRACT

A system for distributing water flow between jet stations in a bathing system, such as a spa, is disclosed. The outlets of two pumps are connected together by a water supply line looped around the water containment. Jet stations are disposed along the supply line and water controllers that selectively block or allow water to flow are placed between the jet stations. By blocking the flow with a water controller, the flow to the jet stations is divided between the two pumps. The distribution of water supply of the jet stations can thereby be adjusted by selecting a water controller where the pump supply line is to be divided between the pumps.

6 Claims, 7 Drawing Sheets

147
153
157
155
141
131
123
139
149
151
119
137
137
127
141
129
125
133
135
127
121
103
159
113
171
117
145
143

JET ZONE DISTRIBUTION SYSTEM FOR SPAS

RELATED APPLICATIONS

This application is a continuation-in-part of Ser.No. 09/037,787, filed Mar. 10, 1998, which is a continuation of Ser. No. 08/677,840, filed Jul. 10, 1996, now U.S. Pat. No. 5,754,989, issued May 26, 1998.

STATEMENT REGARDING FEDERALLY SPONSORED RESEARCH OR DEVELOPMENT (Not applicable)

FIELD OF THE INVENTION

This invention relates to the water distribution systems of bathing systems, such as spas and the like.

BACKGROUND OF THE INVENTION

Bathing appliances in the nature of spas, or so-called hot tubs, have become commercially successful. These spas are typically constructed as a molded shell to form a water containment, with seats, footwells, platforms for reclining, and the like molded into the shape of the shell. The shell is usually molded from plastic or fiberglass or a composite thereof. A pump or pumps usually placed in a chamber under the shell draw water from the water containment and reinject the water, usually with air, into the containment through a variety of nozzles, hydrotherapy jets, and the like. The jets are usually mounted in the shell under the water line, and are designed to provide a comforting or therapeutic effect to a person in the spa. The jets are usually mounted by making a hole in the shell, and fixing the jet in the hole by a use of seals, adhesives, welding compounds, or a combination thereof. Water supply lines from the pumps to the jets are usually flexible tubing or rigid PVC tubing. After the jets and tubing are in place, an expandable foaming polymeric material is blown into the empty spaces to provide thermal and sound insulation. This construction system has been used widely and successfully, and is currently almost universally used.

One of the problems of conventional spa construction is that the configuration of the spa is essentially fixed at the time of construction. Since the jets are fixed in a hole in the spa shell, replacement of the jet is difficult or impractical. Replacement in the least would required an extensive reconstruction involving removing the old jet (usually by cutting out the jet), and installation of the new jet requiring repair and resealing of the shell around the new jet. In addition, the water and air supply lines to the jets must be replaced or reinstalled on the new jet, requiring access from the bottom of the spa and removal and replacement of the foam insulation surrounding the lines. Because such replacement is burdensome, a user will usually avoid a jet replacement unless absolutely necessary. If a new jet type is introduced into the market or the tastes of the bather change for a difference jet type, the difficulties of replacement basically preclude user from changing the jets.

Another problem involving jet replacement is that the water supply systems or jets are usually buried in insulating foam under the spa shell. If a jet is replaced with a different type that requires a different water flow, the function of the remaining jets attached to the same pump can be compromised as the pressure drops or rises due the increased or decrease flow through the new jet. It may be possible to solve the problem by installing a pump of a different capacity, or by rearranging the water supply lines between different pumps in the spa to redistribute the water flow between the pumps. However, both alternatives are expensive, and the later involves extensive labor in digging out the old piping and reinstalling the new.

DISCUSSION OF PREVIOUS APPLICATION

In U.S. Pat. No. 5,754,989, which is hereby incorporated by reference, is disclosed a spa wherein jets are mounted upon removable panels, that represent the back rests for various reclining positions in the spa. Basically the system disclosed comprises a spa shell with hollows or pods molded into the spa shell. The jets are mounted to direct water into the spa containment by attachment to the removable panel, which is also cover over the pod. Jet supply lines are attached to the back side of the removable panel and communicate with a water supply by a removable attachment. This allows a user to easily remove the panel and the water supply lines of the jets in order to replace a panel. The removable panel covers the pod and also includes structure for attaching the top of the panel to the spa shell, and usually also includes a surface that functions as a head rest or an attachment for a separate head cushion.

The removable panel system has proven to be successful in providing an easy user-upgradable system. To replace a malfunctioning jet or upgrade to a new jet configuration, the user easily disconnects the top of the panel from the shell to gain access to the manifold system, disconnects jet supply lines at the manifold, and removes the panel. A new panel with the new jet is then inserted in place by first inserting the bottom of the panel under the retaining lip of the hollow, reattaching the jet supply lines and reattaching the top of the panel.

However, with this system, a water distribution problem can occur if a jet is replaced with the new jet with a different water capacity. After jet replacement, each manifold is supplied by the same pump as originally installed, so there is a potential of mismatching the jet flow requirements and the pump capacity as jet panels are upgraded.

It would therefore be desirable to provide the easy upgradability as in the system of U.S. Pat. No. 5,754,989, but providing a greater flexibility in adjusting the jet flow requirements to the pump capacities and adjusting the flow circuits for each pump in the spa without a major reconstruction.

OBJECTS OF THE INVENTION

It is, therefore, an object of the invention to provide system for adjusting and distributing the flow in a spa, without having to rebuild the spa.

Further objects of the invention will become evident in the description below.

BRIEF SUMMARY OF THE INVENTION

The present invention is a system for distributing the water flow from two pumps to several jet stations. The pump outlets are connected together by a looped water supply line. Jet stations are disposed on the water supply line. Between each adjacent pair of jet stations is a water control structure that selectively allows or blocks water through the water supply line. By setting the water control structures, the water supply for the jet stations can be variably adjusted and distributed between the jet stations.

In a preferred embodiment of the invention, the jet stations comprise removable jet assemblies. The connectors on either side of the assembly can then be modified to also function as water controllers. This allows easy access to the water controllers and allows the user to set the controllers when the jet assemblies are installed.

INDEX OF REFERENCE NUMBERS

Figure 1:
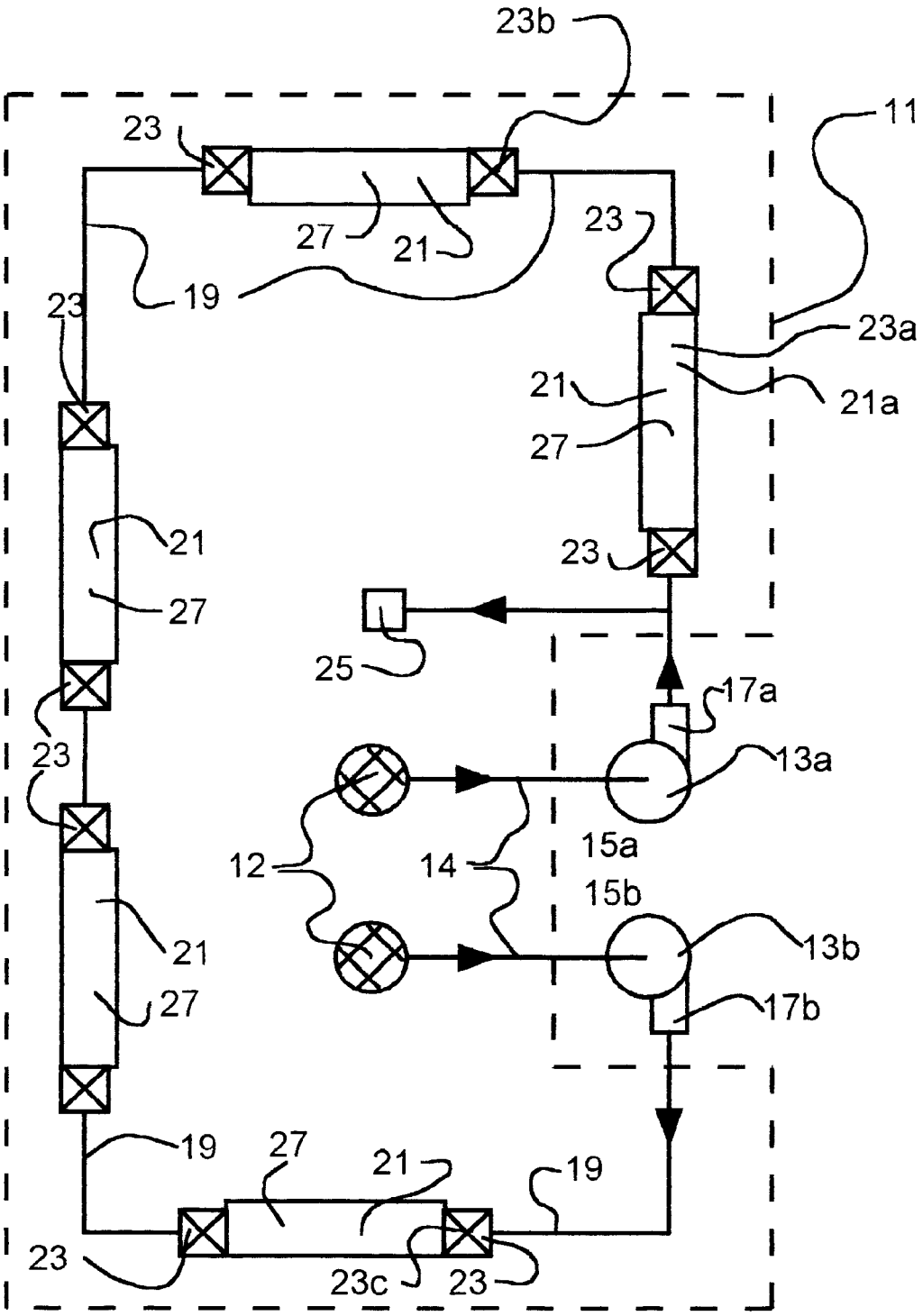
FIG. 1 is a schematic of an embodiment of the invention.
Figure 2:
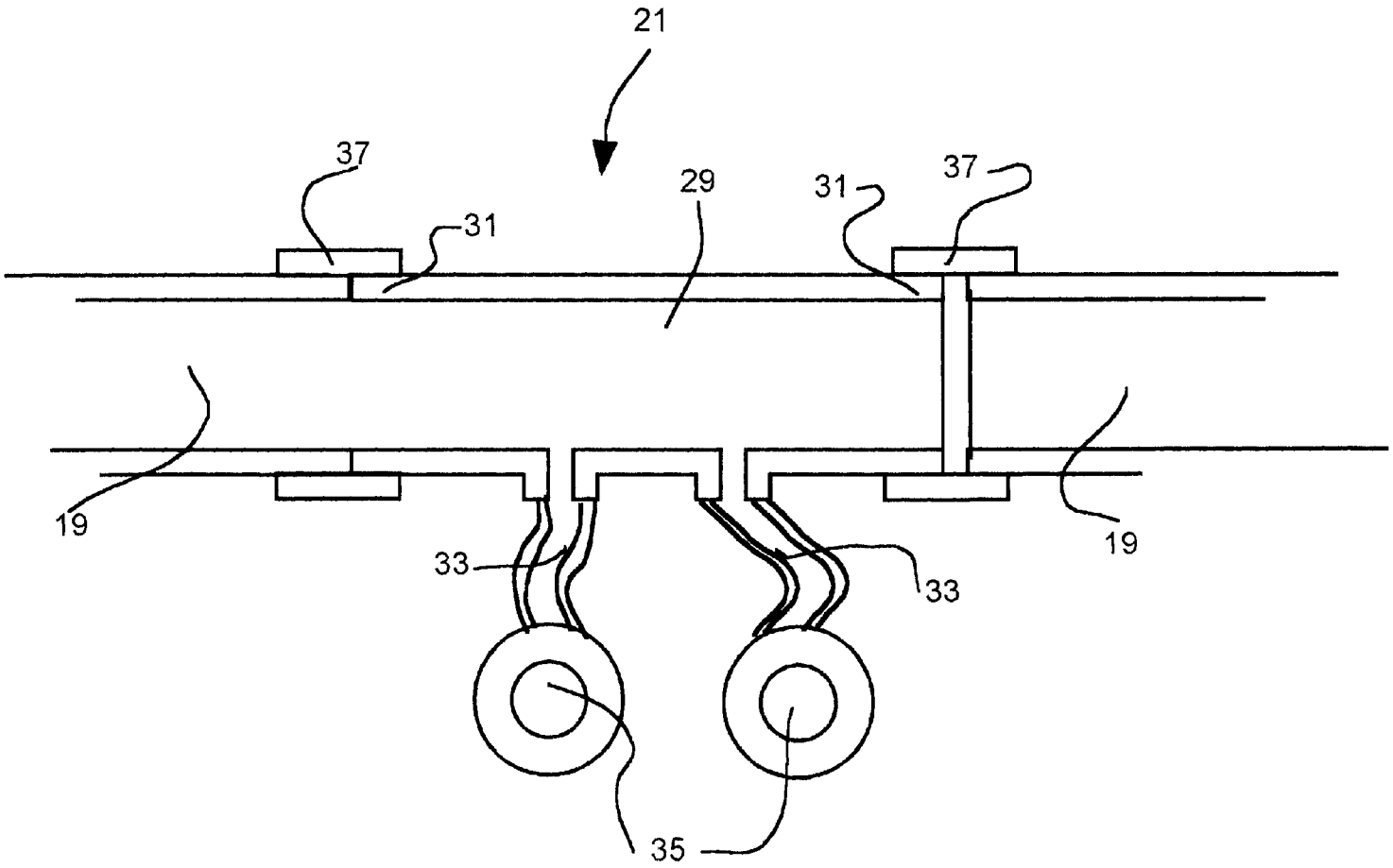
FIG. 2 is a schematic of a jet assembly of the invention.
Figure 3:
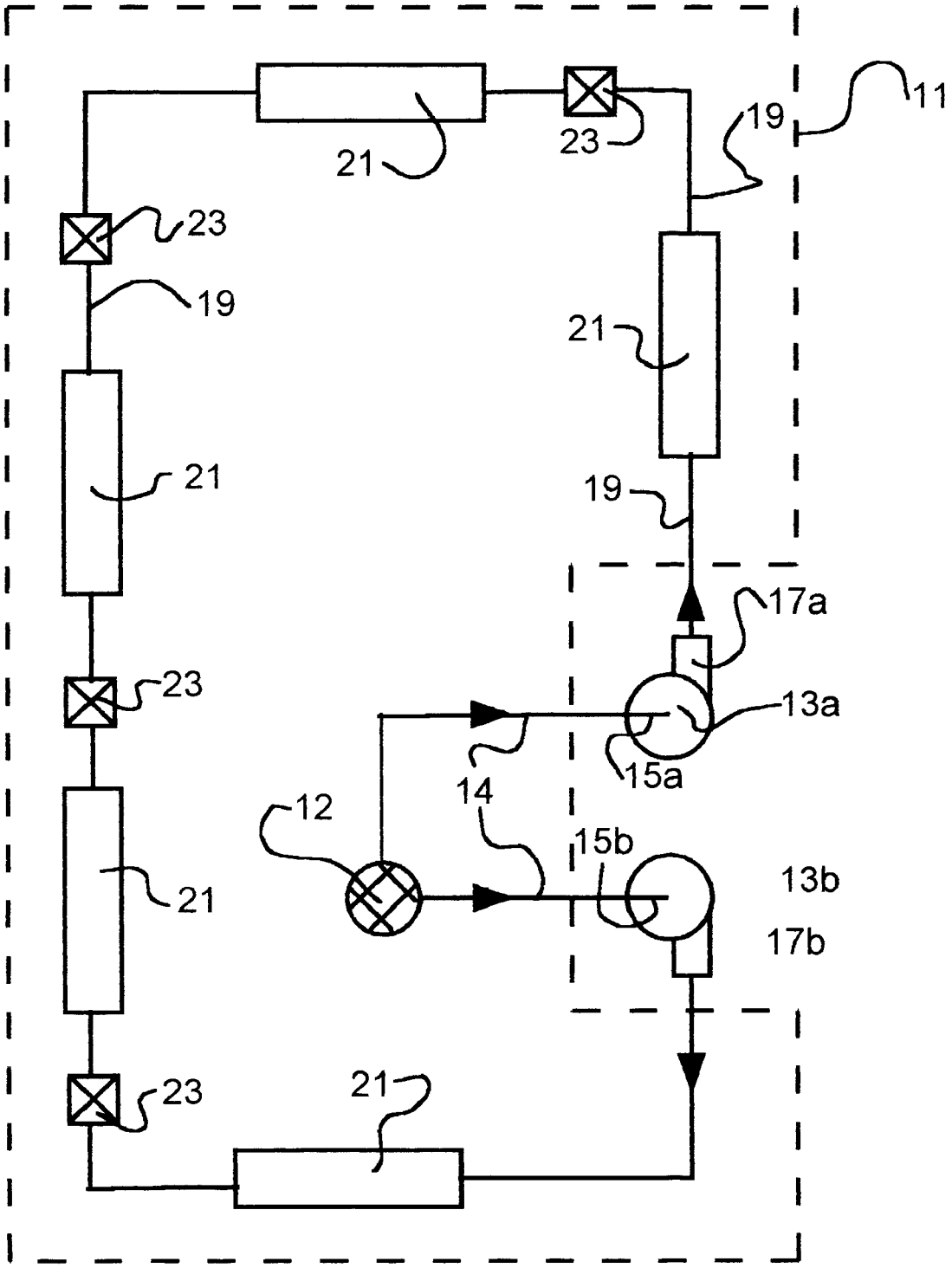
FIG. 3 is a schematic of another embodiment of the invention.

For FIGS. 1 to 3

| | |
|---|---|
| 11 | containment |
| 12 | drains |
| 13a | first pump |
| 13b | second pump |
| 14 | pump inlet lines |
| 15a | first pump inlet |
| 15b | second pump inlet |
| 17a | first pump outlet |
| 17b | second pump outlet |
| 19 | water supply line |
| 21 | jet stations |
| 21a | a specific jet station |
| 23 | flow controller |
| 23a | a specific controller |
| 23b | a specific controller |
| 23c | a specific controller |
| 25 | floor thruster jet |
| 27 | jet assembly |
| 29 | manifold |
| 31 | manifold ends |
| 33 | jet conduits |
| 35 | jets |
| 37 | connectors |

For FIGS. 3 to 7

| | |
|---|---|
| 101 | spa |
| 103 | shell |
| 105 | containment |
| 107 | skirt cabinet |
| 109 | platform |
| 111 | foot well |
| 113 | jets |
| 115 | drain |
| 117 | jey panel |
| 119 | pod |
| 121 | water supply line |
| 123 | manifold |
| 125 | manifold ports |
| 127 | jet water supply lines |
| 129 | manifold pipe section |
| 131 | manifold sleeve |
| 133 | jet air inlet |
| 135 | jet water inlet |
| 137 | jet air supply lines |
| 139 | air supply system |
| 141 | union connectors |
| 143 | mounting ridge in shell |

-continued

| | |
|---|---|
| 145 | lower edge of jet panel |
| 147 | top panel |
| 149 | front ridge of top panel |
| 151 | top edge of jet panel |
| 153 | side holding pins |
| 155 | rear holding pins |
| 157 | top panel fingers |
| 159 | jet outlet |
| 171 | jet assembly |
| 173a | first pump |
| 173b | second pump |
| 175 | pump supply lines |
| 177a | first pump outlet |
| 177b | second pump outlet |
| 181 | first mating and sealing surface |
| 183 | male member |
| 185 | threads on male member |
| 187 | second mating and sealing surface |
| 189 | female collar |
| 191 | threads on female collar |
| 193 | locking ridge on manifold |
| 195 | lip on female collar |
| 197 | plug |
| 199 | groove |
| 201 | handle |

DETAILED DESCRIPTION OF THE INVENTION

Reference is now made to FIG. 1, which is a schematic of a water distribution system of the invention. The system comprises a containment 11, and two water sources, shown here respectively as first and second pumps 13*a*, 13*b*. The pumps 13*a*, 13*b* draw water from the containment 11 through drains 12 and pump inlet lines 14 to pump inlets 15*a*, 15*b*, and out through respective first and second pump outlets 17*a*, 17*b*. The outlets 17*a*, 17*b* are connected together by a water supply line 19 extending in a circuit or loop from the first outlet 17*a*, to the other second inlet 17*b*. At selected points in the water supply line 19 are jet stations 21. A jet station 21 is a point where one or more jets are connected to the water supply line 19 and water is drawn from the water supply line through the jet into the containment. The water supply line is preferably disposed around the periphery of the containment, and may be either above or below the water line.

The jet station preferably comprises a jet assembly, which is defined as an assembly including a at least one jet and a connection system for disconnecting the jet assembly from the water supply line. A jet assembly 27 is illustrated schematically in FIG. 2, and comprises a two-ended manifold system 29 constructed to allow water to flow through the manifold from one end to the other end 31 in either direction. A jet conduit or conduits 33 direct water from the manifold 29 in the water supply line 19 to one or more jets 35. The manifold system 29 provides a removable connection system, i.e., it is connected into the water supply line 19 by appropriate connectors 37 at either end 31. This allows the jet assembly 27 to be removed and reinserted or replaced by a new jet assembly 27. Jet assemblies are preferably disposed in a hollow or pod molded in the spa shell and mounted on a cover that encloses the pod. An example of the jet assembly system is described more fully below.

In the embodiment of FIG. 1, water flow controllers 23 are disposed at either end of each jet station 21. A flow control device is constructed to selectively stop the flow of water through the loop pipe (off), or allow water to flow (on) through the controller. In a preferred embodiment, flow controller devises are disposed at either end of a removable jet assembly, as shown in FIG. 1, This arrangement allows easy access to the flow control devices and also allows the flow control devices to be incorporated into the structure of the connectors, as is more fully described below.

An object of the invention is to distribute the water flow from the two pumps 13*a*, 13*b* to the jet stations 21, based on the water requirements of the individual jet stations. This is accomplished by setting a controller to "off" at the point where the user wishes to separate the water supply line into two water supplies from each pump.

For example, if a particular jet station (also labeled 21*a*) a requires a high water volume to function, the specific controllers 23*a* or 23*b* can be set to "off" to block the flow of water between 21*a* and an adjacent jet station. Jet station 21*a*, then is the only jet station supplied by the first pump 13*a*. Jets requiring a lower water flow are then used in the remaining jet stations, all of which are supplied by the second pump 13*b*. If the high-flow jet station 21*a* is upgraded with a low flow system, the water distribution can be adjusted for more jet stations to be supplied by the first pump 13*a* and fewer jet stations supplied by the second pump 13*b*. If a high flow jet station is configured as a removable jet assembly, it may also be moved to a different point on the supply line. By moving the jet assemblies of different flow rate requirements to various jet station positions in the loop, and setting an appropriate controller between jet stations to off, the flow rate and water supply to each jet station can by optimized. This is accomplished without any replumbing of the system, but by merely setting the flow controllers appropriately and adjusting the position of the jet stations.

In normal operation, all of the controllers are on except for only one flow controller that is off, with jet stations on either side of the off controller supplied respectively by the two pumps. In FIG. 1, the particular controller 23*c* would normally by always on, and exists so that all of the jet assemblies and controllers of the spa are constructed in a compatible and interchangeable manner. Other jets that are not directly in the water supply loop may also optionally be in the spa, and supplied at any suitable point from the loop, as shown by the jet 25, in FIG. 1. Such a jet may be for example, a high-pressure thruster jet in the floor of the spa containment. In addition, jet stations that are adjacent may operationally be consolidated into one jet station by eliminating the water controller between them. However, the of such large consolidated jet stations is preferably kept to a minimum, as this would lessen the ability to distribute the water flow. Water flows from the jet stations 21, circulated into the containment, eventually drawn through the drains 12 and pump inlet lines 14, and reinjected into the containment.

FIG. 3 is a schematic of an alternate embodiment of the invention, with same reference numbers referring to analogous parts as in FIG. 1. In this embodiment the flow controllers 23 are not disposed at the ends of the jet stations 21, but at some other point between the jet stations. A disadvantage of this system is that controllers must be separately accessible from the jet stations. The embodiment in FIG. 1, in contrast, has the same access for the flow controllers as the access for removal jet assemblies and their connectors. Similar to as described above, water-flow can be distributed, as required to the jet stations 21 by setting the flow controllers 23, with one controller off to divide the distribution between the pumps 13*a*, 13*b*, with the remaining controllers on.

The invention also allows a simple method for removing or disabling a jet station without disabling the entire spa. In the event jet station 21 malfunctions, controllers on either side can be set to off and the remaining jet stations will continue to function. The disabled jet station can even be removed for repair, while still retaining the function of the remaining jet stations. When the repaired or a new jet assembly is reinstalled, the controllers are then set to supply and distribute water to the jet assemblies as described above.

The flow controllers can be any suitable structure for selectively turning water flow on or off through the controller.

These include conventional water valves of any suitable type. These valves are most suited for an installation as in FIG. 3, with separate molded hollows with panels in the spa shell for access to the valves.

Preferably, the flow controllers are incorporated into the structure of connectors of a removable jet assembly. The connectors connect the ends of the jet assembly manifolds into the water supply loop. When the jet assembly is installed by attaching the connectors, the flow controllers can be appropriately set on or off at the same time. Many connectors involve the mating of surfaces of conduits to be connected and structure for clamping or holding the surfaces together, often with a seal to prevent leakage. Such a connector can become a flow controller by providing a suitably constructed plate to be inserted between the mating surfaces, in place of or in addition to the seal. Alternately, a plug can be formed to plug either connecting conduit at or near the mating surfaces. The plug is held in place and blocks the water flow by a sealing engagement with sides of the flow conduit and/or with any appropriate holding structure, such are ridges or lips. For an "on" condition, the connector is used as-is to allow water to flow through the connector. For an "off" condition, the plate is inserted to block the flow of water through the connector. Connectors of this type, include various union connectors, compression connectors and flange connectors Referring to FIG. 4, which is a perspective view of a spa incorporating the invention, the spa 101 comprises a shell 103 to provide a containment 105 for water, and a skirt cabinet 107 that conceals the support structure, the pumping, filtration and circulation equipment, etc. The shell 103 and the skirt 107 are constructed in a conventional manner, i.e., the shell being of fiber glass, or other suitable material, with a foam insulation under the shell. The shell 103 is usually shaped to incorporate one or more seating or lounging platforms 109 and a foot well 111.

The spa 101 includes jets 113 through which water, usually mixed with air, is directed under pressure into the containment 105. A drain 115 or drains are provided to withdraw water from the containment, which is then recirculated back into the containment through the jets 113.

Figure 5:
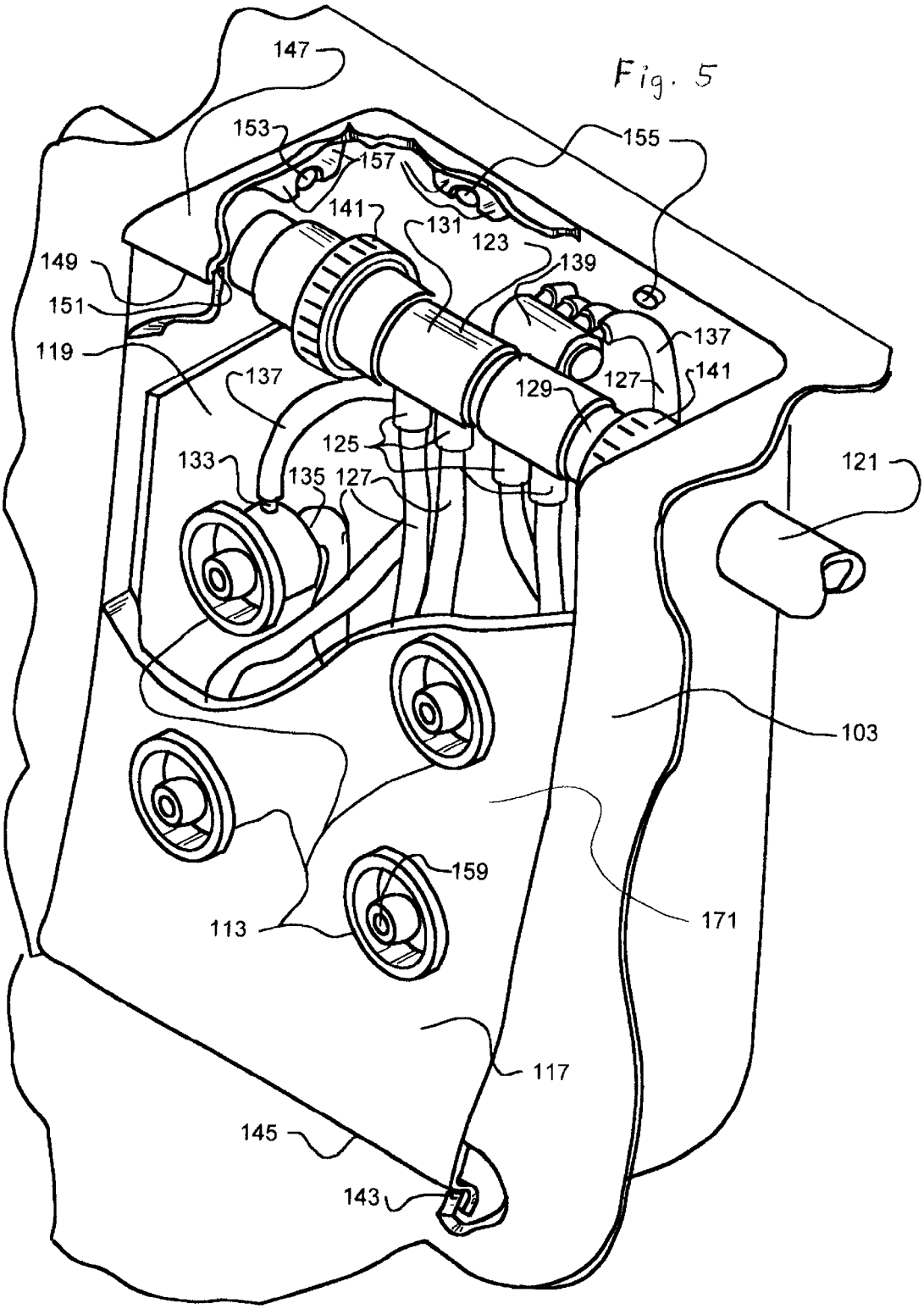
FIG. 5 is a perspective view in partial section of a jet and water supply assembly of a spa similar to that in FIG. 4.

Referring also to FIG. 5, the jets are mounted on a jet panel 117 that provides a cover over a well or pod 119 molded into the shell. Preferably, the outer surface of the jet panel 117 is generally flush with the adjacent surface of the shell 103.

A water supply line 121 enters the pod 119 from a side of the pod and extends through the pod 119 to the other side. The water supply line is preferably mounted around the periphery of the containment above the water line as disclosed in U.S. Pat. No. 5,754,989, which is hereby incorporated by reference. A manifold 123 provides one or more ports 125 as needed for jet water lines 127 that feed water to one or more jets 113 mounted on the jet panel 117. The manifold 123 is constructed to form a releasable attachment of the jet water lines 127 to the water supply line 121, to enable a user to disconnect the jet water lines 127 and jets 133, and manifold 123 from the water supply line 121. In the figure, the manifold 123 is formed with a pipe section 129 from the same pipe material as the water supply line 121 with a sleeve 131 covering the pipe section 129. The sleeve 131 is formed with one or more ports 125 for connection to the flexible jet water lines 127 that supply pressurized water to the jets 113. The jets 113 may be of any suitable construction, usually comprising an air inlet 133 and water inlet 135. The jet 113 mixes air and water and directs the mixture as a single pressurized steam into the containment. In the figure, the water and air inlets 135, 133 are shown on the side and the back of the jet, respectively, but the jet may also be configured differently, for example with both ports on the side, or back. The air inlet 133 of each jet 113 is connected via air supply lines 137 to an air intake system 139, which is the figure is an air supply manifold and an air filtering system. On either end of the water supply manifold are union connectors 141 which allow easy disconnection and removal of the jet assembly 171 and are modified, as described below, as flow controllers. The jet assembly 171 comprises the manifold 123, jet water and air lines 127, 137, air supply manifold 139, and associated jets 113. This allows easy replacement, maintenance, upgrading or repair of any components of the jet assembly 171.

The jets in the pod are supported on the pod cover plate or jet panel 117, which covers the cavity or depression forming the pod 119. The jet panel 117 is held in place at its bottom edge by engagement with the spa shell, e.g., as in FIG. 2 by a ridge 143 on the shell 103 at the bottom periphery of the pod 119 to engaging the lower peripheral edge 145 of the jet panel 117. The attachment of the jet panel 117 to the shell edges is preferably non-sealing with respect to water to permit free passage of water between the interior of the pod 119 and the major containment 105 of the shell. Alternately the jet panel 117 may have apertures (not shown) for the flow of water.

The top of the jet panel 117 is supported by a top panel 147, which also functions as a top cover of the pod 119. The top panel 147 has appropriate structure, such as a front ridge 149, to engage the top edge 151 of the jet panel 117. The top panel 147 is held in place to the shell 103 over the pod 119 by any appropriate structure. In FIG. 2 are shown side and rear holding pins 153, 155 mounted on the shell. The top panel includes fingers 157 in a generally inverted U-shape configuration to engage the side and rear holding pins 153, 155. By providing pins 153, 155 on both of the back and the side of the pod 119, the top cover is restrained from movement both front to back and side to side. Alternate construction is contemplated for supported the top panel, such as, for example, shelf structure in the shell that supports the lateral edges of the panel. Appropriate screws, clamps, clips or other fasteners (not shown) may be used to further secure the cover in place.

The jet panel 117 is preferably configured to provide a pleasing visual appearance and to provide a comfortable resting surface for the back of a bather. The top panel 147 may be shaped as a plain cover as shown or, preferably, constructed to incorporate a head rest surface, cushion, or other suitable head rest. Since the manifold 123, and associated supply lines 137, 127, etc., are hidden in the pod by the jet and top panels 117, 147, the only visible part of the circulation system is the outlet of the jet 113. There no projecting pipes or the like that would be unsightly or present a hazard. Visually speaking, essentially the only difference between the water containment of a spa of the invention and a prior art spa is the inconspicuous joints around the top and jet panels where they fit into the shell. The jet panel 117 and top panel 147 may also be optionally configured to provide ridges or contours to provide decoration or custom contours. In the jet panel 117, contours may be molded for lumbar back support.

Figure 4:
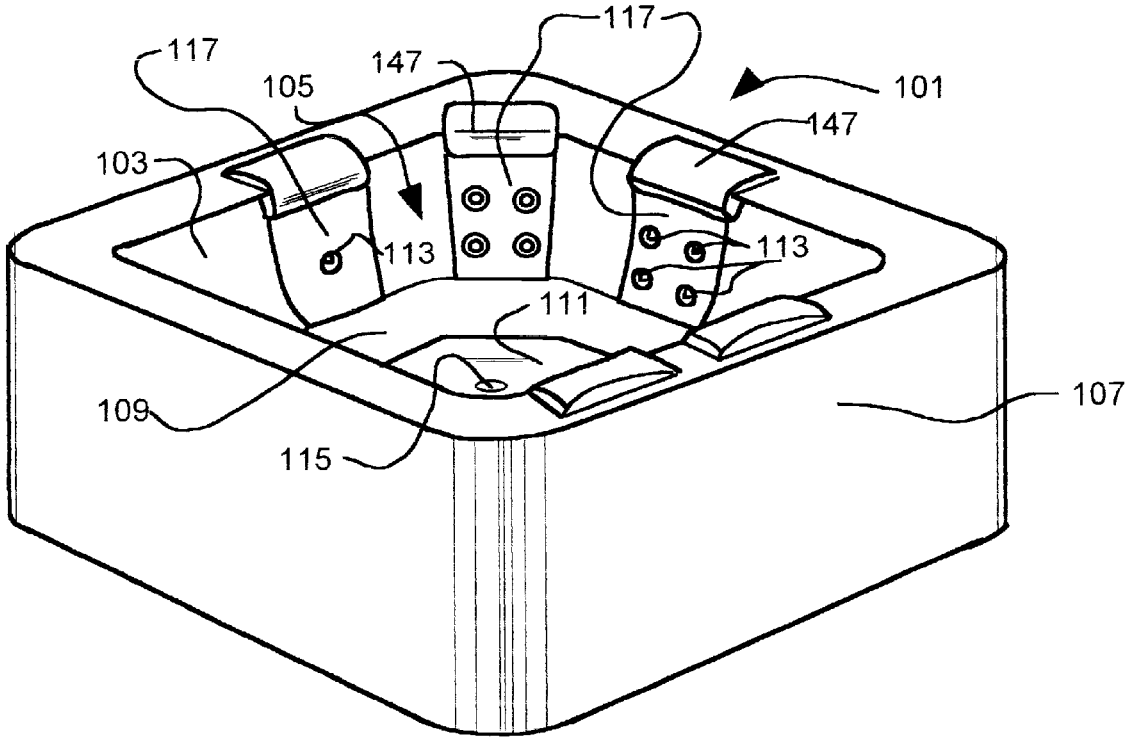
FIG. 4 is a perspective view of a spa incorporating the water distribution system of the invention.
Figure 6:
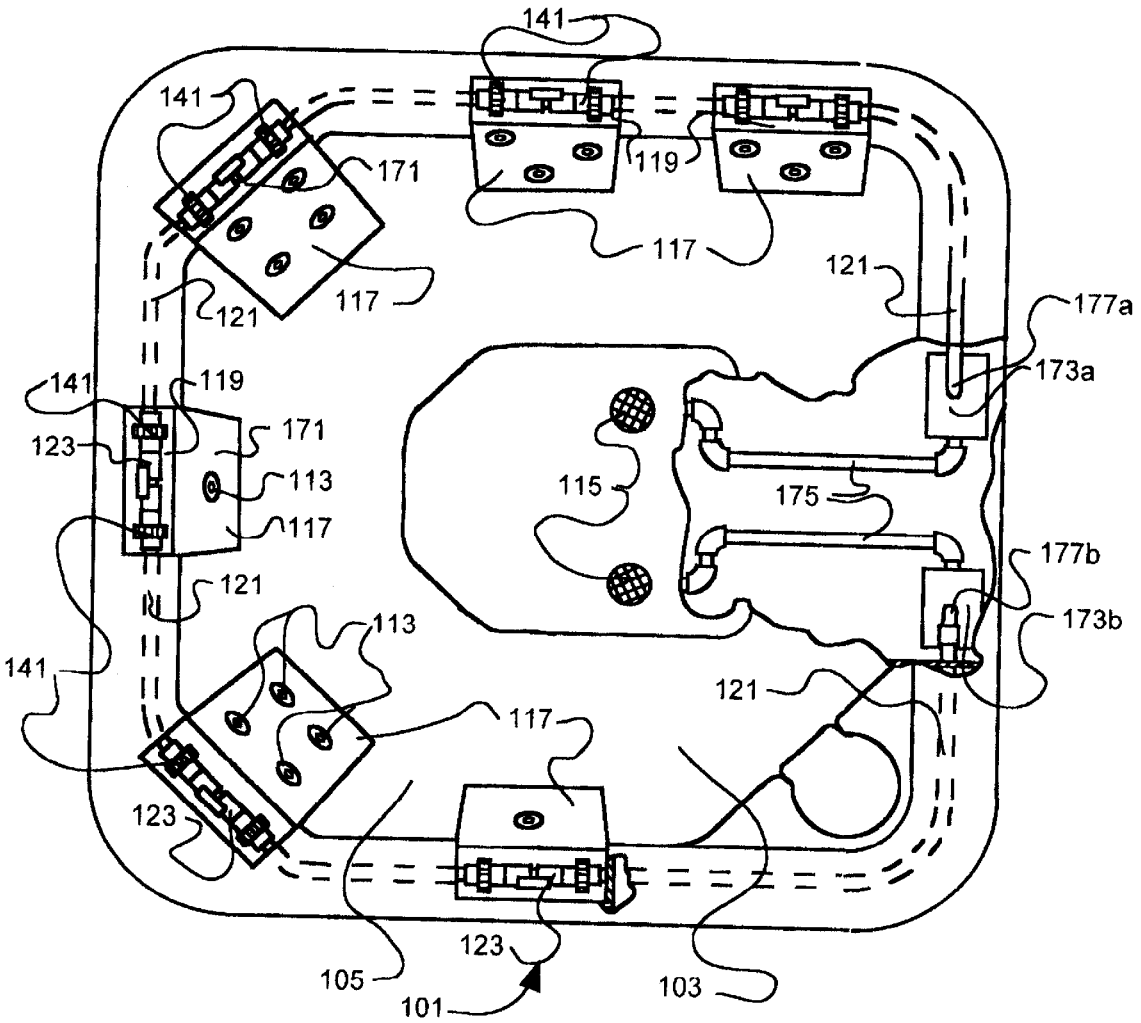
FIG. 6, is an overhead view in partial section showing the water supply system of a spa similar to that in FIG. 4.

Reference is now made to FIG. 6, which is a top view of spa constructed similar to that in FIG. 4. Shown are first and second pumps 173*a* and 173*b*, which draw water from drains 115 though pump supply lines 175 and through respective first and second pump outlets 177*a*, 177*b*. The outlets are connected together by the water supply line 121 looped around the periphery of the spa from one pump outlet 177*a*to the other outlet 177*b*. Installed within this loop are jet stations that comprise jet assemblies 171 connected into the loop by union connectors 141, which are also flow controllers.

Figure 7:
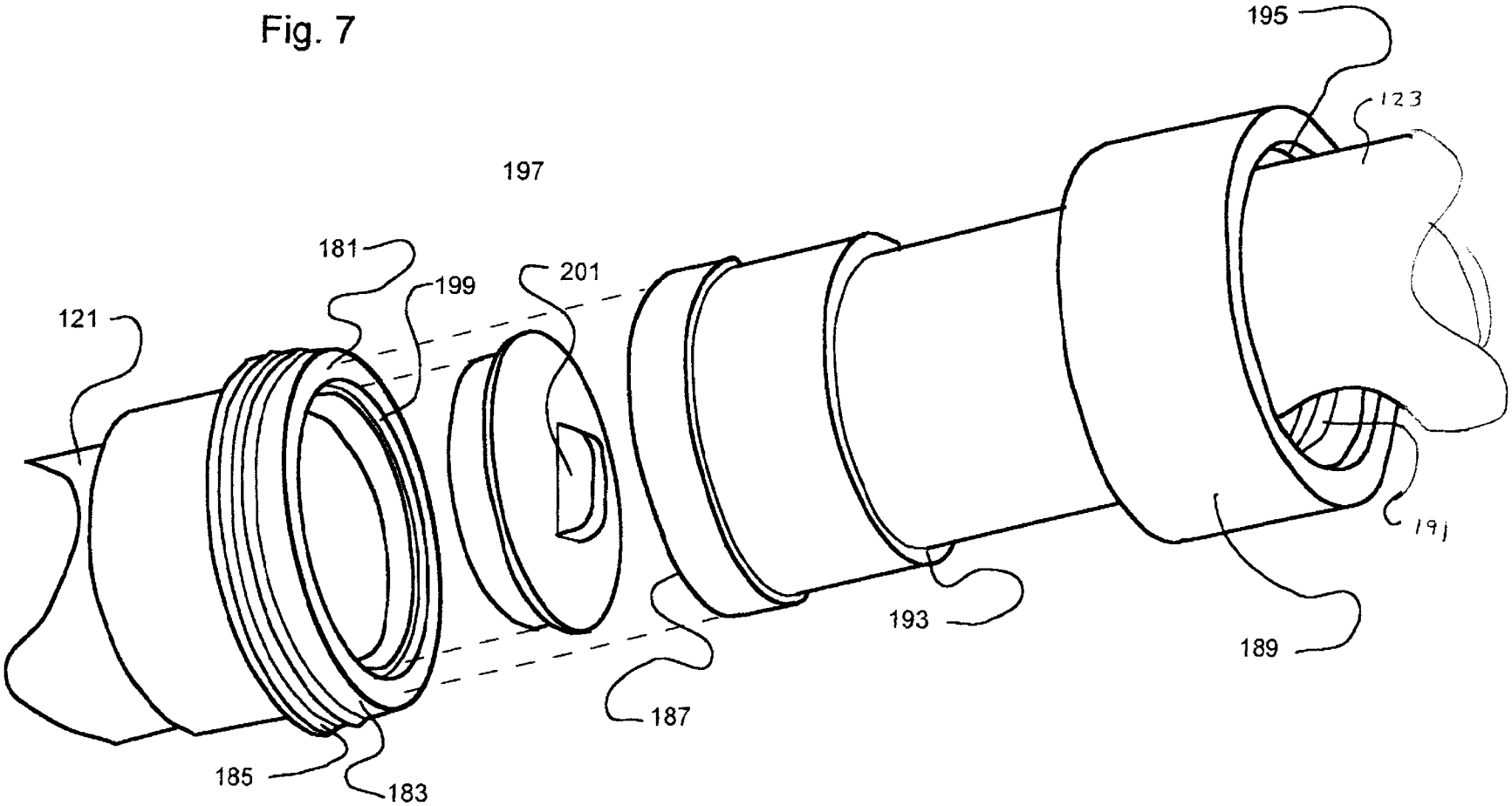
FIG. 7 is a detail of a union connection from the water supply assembly in FIG. 5 incorporating the water flow structure according to the invention.

The union connectors 141 are set in an "on" or "off" flow condition by modifying the connector. This is accomplished by constructing a plug that is selectively left out of the connector or inserted in the flow channel of the connector. Referring to FIG. 7, a union connector 141 connects the water supply line 179 with manifold 123 (only the ends are shown). Attached to the supply line 121 is a first mating and sealing surface 181 and a male member 183 with threads 185. A second mating and sealing surface 187 on the manifold 123 is constructed for a sealing engagement with the first mating surface 181. A female collar 189 with threads 191 engages the threads 185 on the male member and holds the first and second mating surfaces 181, 187 together. A locking ridge 193 on the manifold 123 that engages a lip 195 on the female collar 189 holds the collar to the manifold, and allows the collar 189 to clamp the manifold 123 to the supply line 121 at their mating surfaces 181, 187. In a water-controller "on" condition, water will flow in either direction through the interior of the loop pipe, the male member and the manifold. To switch the controller to an "off" condition, a plug 197 is placed into the male member 183 to block the water flow channel. It is dimensioned to engage a groove 199 in a holding and sealing arrangement near the mating sealing surface 181. A handle 201 is optionally provided to assist in installation and removal of the plug 197. With the plug in place, the first and second mating and sealing surfaces 181, 187 are clamped to prevent leakage, and water flow through the connector 141 is stopped by the plug 197.

In an alternate construction, a plate may be placed between the sealing surfaces. The plate may replace any seal or be in addition to any seal on either of the sealing surfaces.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A system for distributing water flow between multiple jet stations in a bathing system; the system comprising:

a first and second pump, each pump drawing water from a water containment and directing the water through respective first and second pump outlets;

a jet water supply line that extends from said first outlet in a loop around the water containment and to said second outlet;

multiple jet stations, each comprising at least one jet, said jet stations being positioned at selected points on the water supply line, such that water for the jets is drawn from the water supply line, is directed from the water supply line to jets and passes through jets into the containment;

water controllers disposed in the water supply line, each water controller located at a point between adjacent jet stations, such that water may be selectively blocked or allowed to flow between adjacent jet stations, and jet stations may be selectively supplied by either the first pump or the second pump.

2. A system for distributing water flow between multiple jet stations in a bathing system as in claim 1 wherein at least one jet station comprises an assembly of at least one jet and a removable connector for removing the assembly from the water supply line.

3. A system for distributing water flow between multiple jet stations in a bathing system as in claim 2 wherein the removable connector functions as at least one of the water controllers.

4. A system for distributing water flow between multiple jet stations in a bathing system as in claim 3 wherein the removable connector comprises a plate that is placed between mating surfaces of the connector and is selectively inserted into the connector to block the water flow, or removed to allow water between the jet stations.

5. A system for distributing water flow between multiple jet stations in a bathing system as in claim 3 wherein the removable connector comprises a plug that is selectively inserted into the connector to block the water flow, or removed to allow water to flow between the jet stations.

6. A system for distributing water flow between multiple jet stations in a bathing system as in claim 1 wherein the water controller is a valve.

* * * * *